US011136649B2

(12) United States Patent
Trumble et al.

(10) Patent No.: US 11,136,649 B2
(45) Date of Patent: Oct. 5, 2021

(54) COPPER BASED CASTING PRODUCTS AND PROCESSES

(71) Applicant: Purdue Research Foundation, West Lafayette, IN (US)

(72) Inventors: Kevin Paul Trumble, West Lafayette, IN (US); Kevin Joseph Chaput, Meritt Island, FL (US)

(73) Assignee: Purdue Research Foundation, West Lafayette, IN (US)

( * ) Notice: Subject to any disclaimer, the term of this patent is extended or adjusted under 35 U.S.C. 154(b) by 701 days.

(21) Appl. No.: 15/105,998

(22) PCT Filed: Dec. 22, 2014

(86) PCT No.: PCT/US2014/071793

§ 371 (c)(1),
(2) Date: Jun. 17, 2016

(87) PCT Pub. No.: WO2015/100193

PCT Pub. Date: Jul. 2, 2015

(65) Prior Publication Data

US 2016/0312339 A1 Oct. 27, 2016

Related U.S. Application Data

(60) Provisional application No. 61/919,917, filed on Dec. 23, 2013.

(51) Int. Cl.
*C22C 9/05* (2006.01)
*B22D 21/02* (2006.01)

(52) U.S. Cl.
CPC ..... *C22C 9/05* (2013.01); *B22D 21/025* (2013.01)

(58) Field of Classification Search
None
See application file for complete search history.

(56) References Cited

U.S. PATENT DOCUMENTS 4,204,883 A * 5/1980 Smith ..... C22C 9/01 148/435
4,402,906 A * 9/1983 Ueda ..... C22C 9/05 420/470
2013/0094989 A1* 4/2013 Trumble ..... C22C 9/05 420/493

* cited by examiner

*Primary Examiner* — Anthony M Liang
(74) *Attorney, Agent, or Firm* — Purdue Research Foundation

(57) ABSTRACT

A method of casting an article includes forming a melt comprising copper, introducing manganese into the melt to produce a copper-manganese alloy, and casting the copper-manganese alloy in a mold to form the article. The carbon and oxygen contents of the copper-manganese alloy are controlled in order to control the formation of graphite, manganese carbide, and/or manganese oxide particles within the article. Copper-manganese alloys containing carbon are also provided, as well as articles made therefrom in cast or wrought form.

15 Claims, 10 Drawing Sheets

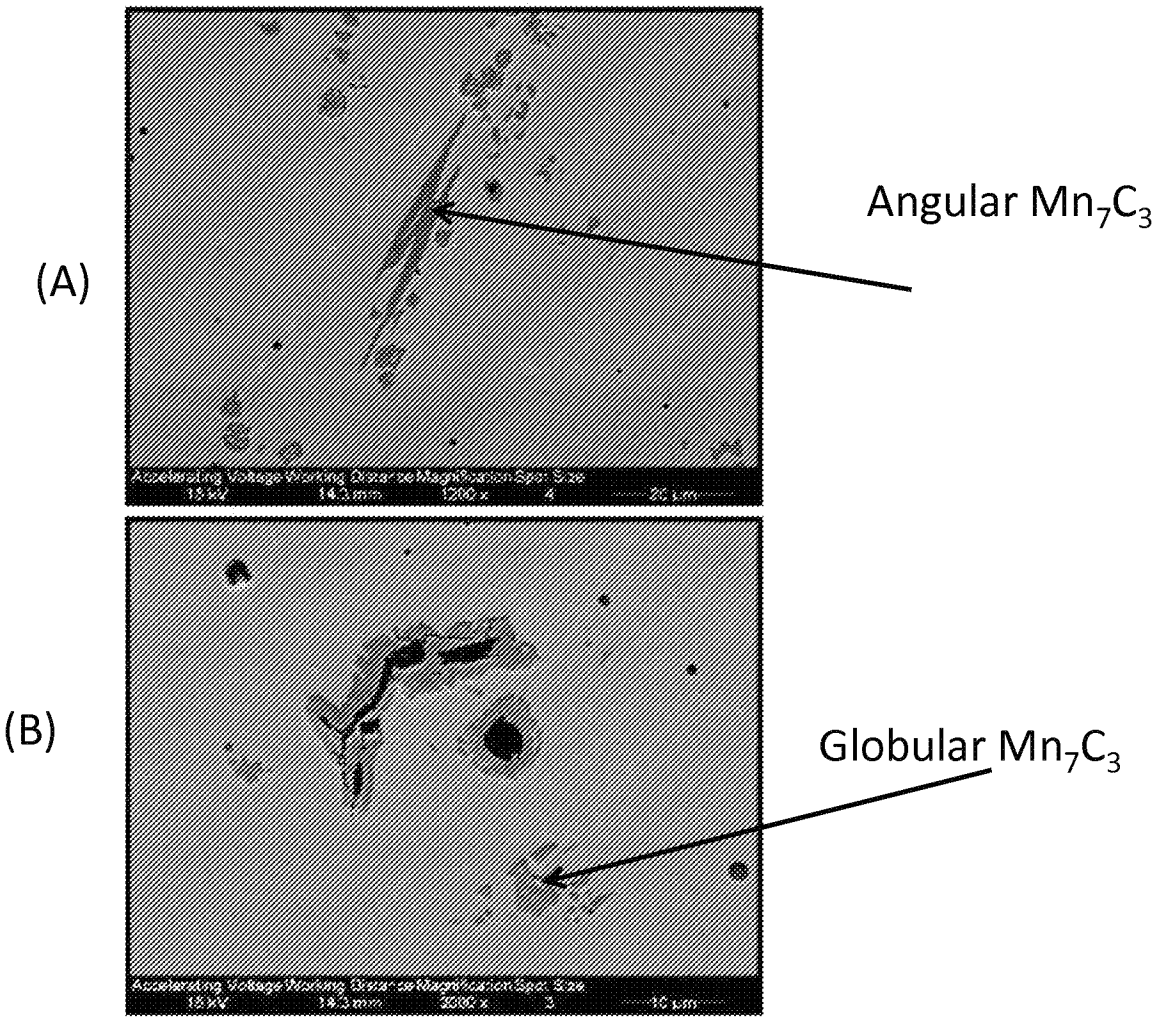
FIGs. 5 (A) and 5(B)

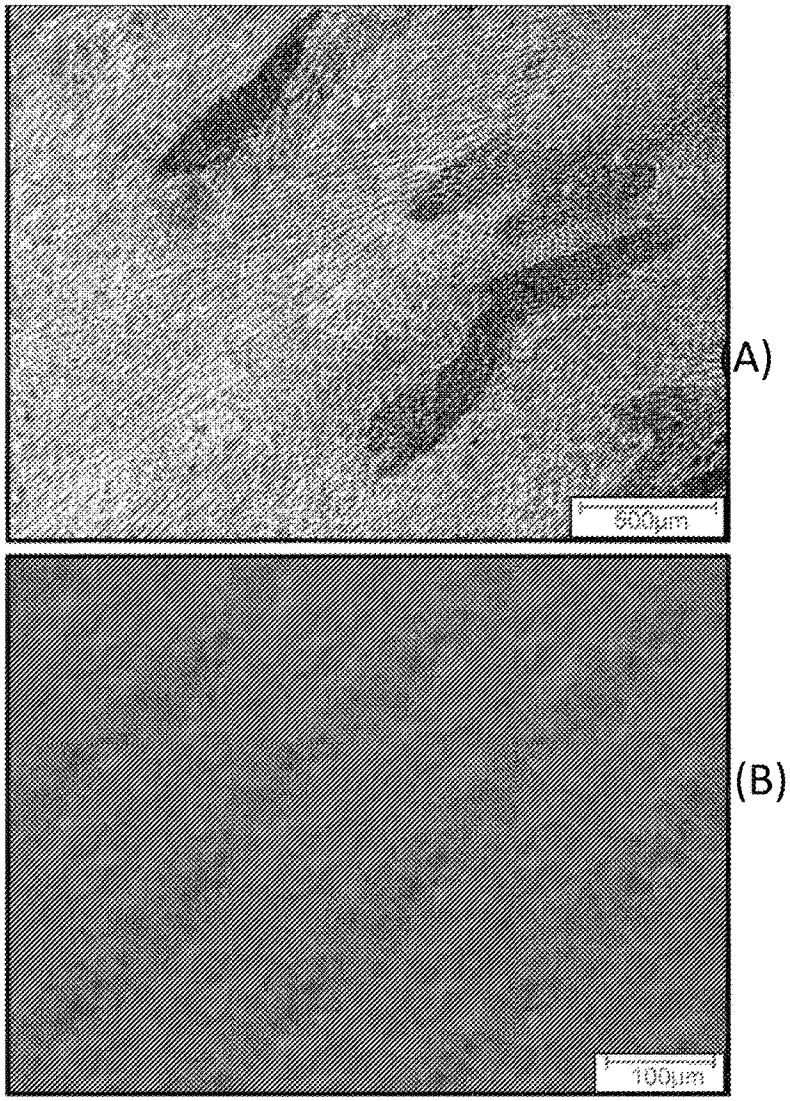
FIG. 6 (A) and 6(B)

(A)

(B)

COPPER BASED CASTING PRODUCTS AND PROCESSES

CROSS-REFERENCE TO RELATED APPLICATIONS

The present patent application is a 35 U.S.C. § 371 national phase application of PCT/US2014/071793, filed Dec. 22, 2014, which is related to and claims the priority benefit of U.S. Provisional Patent Application Ser. No. 61/919,917 filed Dec. 23, 2013 the contents of which are incorporated herein by reference in their entirety into the present disclosure.

TECHNICAL FIELD

The present disclosure generally relates to copper-manganese alloys, especially copper-based alloys suitable for casting as well as wrought forms of copper-manganese alloys.

BACKGROUND

This section introduces aspects that may help facilitate a better understanding of the disclosure. Accordingly, these statements are to be read in this light and are not to be understood as admissions about what is or is not prior art.

The present invention generally relates to copper-based alloys that are suitable for use in the production of castings (for example, plumbing castings), wrought forms (for example, produced by rolling, drawing, forging, etc.), and potentially other forms. The invention also relates to the production and processing of such alloys, and particularly processes that are capable of controlling the amounts of second phase particles within the composition of such alloys.

Alloys based on Cu and Mn in wrought form are well known for special characteristics, such as mechanical damping capacity, resiliency and magnetic behavior. With the exception of these specialty alloys, Mn is usually a secondary alloying element in Cu. The most common example is the high-strength yellow brasses, also known as manganese bronzes (C86X). Despite the name, these alloys typically contain only 1 to 3 weight percent Mn. The alloys are strengthened primarily by 3 to 6 weight percent Al, and may also contain relatively large amounts of Zn, for example, about 20 to 40 weight percent. The Mn bronzes originally found application where high strength in the as-cast condition was required, such as large propellers. This application apparently helped build the reputation of Mn bronze for service under marine conditions, although the extent to which Mn is responsible for the corrosion performance of these alloys remains unclear.

A class of aluminum bronzes (C957) contain 11-14 weight percent Mn, together with lower concentrations of Al, Ni and Fe. Also developed for cast propellers, C957 was replaced long ago for this application by C958, a nickel-aluminum bronze, which contains only about 1 weight percent Mn and higher Al and Ni concentrations. This development suggests that the role of Mn in marine corrosion resistance is at least not critical compared to that of Al and Ni.

Manganese brass, C9970, also known as white brass, contains 11 to 15 weight percent Mn and about 20 weight percent Zn, with about 5 weight percent Ni, up to 3 weight percent Al and smaller amounts of Sn and Pb. A higher manganese alloy is registered as C9975, containing 17 to 23 weight percent Mn. These specialty alloys are used primarily in decorative applications for their silver color. Finally, the specialty wrought alloy C996 known as Incramute™ (registered trademark of International Copper Research Association) contains 39 to 45 weight percent Mn with 1 to 3 weight percent Al and smaller concentrations of other elements. This alloy is a commercial example of the class of high-Mn alloys noted for vibration damping capabilities.

Manganese-containing copper alloys have also been the subject of academic research. Two examples are Schievenbusch et al., "Directional Solidification of Near-azeotropic Cu Mn-alloys: a Model System for the Investigation of Morphology and Segregation Phenomena," 1S1J International, Vol. 35, No. 6, p. 618-623 (1995), and Zimmermann et al., "Morphology and Segregation Behaviour in Directionally Solidified Copper-Manganese Alloys with Compositions Near the Melting Point Minimum," Materials Science Forum Vol. 215-216, p. 133-140 (1996). These papers investigate Cu—Mn alloy compositions that undergo cellular and dendritic growth during directional solidification as a result of their compositions containing manganese contents that are intentionally above or below the "azeotrope" or (more properly) congruent point or minimum in the liquidus/solidus of the Cu—Mn phase diagram, shown in FIG. 1 (N. A. Goken, "Journal of Alloy Phase Equilibria," 14 [1] p. 76-83 (1993)). Though there is uncertainty regarding the exact composition at the congruent point of the Cu—Mn system, Goken placed the congruent point at 34.6+/1 1.4 weight percent (about 38+/−2 atomic percent) manganese. The particular focus of the investigations reported by Schievenbusch et al. was directional solidification experiments with alloy (Mn) concentrations within a range of +/−5 weight percent around the congruent minimum concentration, and the focus of the investigations reported by Zimmermann et al. used manganese concentrations of a few percent below and above the concentration of the congruent point. The resulting microstructures were cellular as well as dendritic, evidenced by secondary arms developing in the microstructures.

Several aspects of copper-manganese alloys and methods and compositions for avoiding microporosity attributable to dendritic growth are described in United States Published Patent Application No. US2013/0094989 A1 by Trumble, published on Apr. 18, 2013.

Copper-manganese alloys having relatively large amounts of manganese have conventionally been produced in wrought form, for example, products in the form of wires, thin plates/sheets, rods, foils, etc. Microporosity is not a concern in such products as they may be hot and/or cold worked to remove the microporosity, unlike cast products. However, it would be desirable if methods were available for casting copper-manganese alloys that avoid microporosity attributable to dendritic growth.

SUMMARY

A method of casting an article is disclosed. The method includes forming a melt containing copper in a melting vessel, introducing manganese into the melt to produce a copper-manganese alloy, and casting the copper-manganese alloy in a mold to form the article, wherein the carbon and oxygen contents of the copper-manganese alloy are controlled in order to control the formation of graphite, manganese carbide, and/or manganese oxide particles within the article.

According to one embodiment of the method, a graphite disk is placed on a surface of the copper during the step of forming the melt and the graphite disk is removed from the surface of the copper prior to introducing the manganese into the melt.

According to one embodiment of the method, the graphite disk is placed on a surface of the melt after introducing the manganese therein.

According to one embodiment of the method, the melting vessel is a crucible formed of a carbon containing material.

According to one embodiment of the method, the melting vessel is a crucible formed of a material free of carbon.

According to one embodiment of the method, the melting vessel is a crucible formed of a clay-graphite based material.

According to one embodiment of the method, the melting vessel is a crucible formed of one of an alumina based material and a magnesia based material.

According to one embodiment of the method, the melting vessel is a crucible made of a SiC based material.

According to one embodiment of the method, the copper-manganese alloy contains copper and manganese in amounts at or sufficiently near the congruent melting point of the Cu—Mn alloy system to sufficiently avoid dendritic growth during solidification of the copper-manganese alloy to avoid the formation of microporosity attributable to dendritic growth.

According to one embodiment of the method, a deoxidizer is introduced into the melt prior to the step of casting the copper-manganese alloy.

According to one embodiment of the method, the method is performed at a temperature of about 1000 degrees C. or less.

According to one embodiment of the method, the method is performed at a temperature of about 1000 degrees C. or more.

According to one embodiment of the method, the copper-manganese alloy contains manganese content of 25 to 40 weight percent.

According to one embodiment of the method, the copper-manganese alloy contains manganese content of 32 to 36 weight percent.

An article made of a copper-manganese alloy is also disclosed. The article contains an amount of manganese that is at least 25 weight percent and not more than 40 weight percent of a combined total amount of the copper and manganese in the copper-manganese alloy and therefore sufficiently near the congruent melting point of the Cu—Mn alloy system to avoid dendritic growth during solidification of the copper-manganese alloy to avoid microporosity attributable to dendritic growth, the article comprising a cast microstructure free of dendritic growth, the article further containing and manganese carbide precipitates.

An article made of a copper-manganese alloy comprising is disclosed, where in the article contains an amount of manganese that is at least 32 weight percent and not more than 36 weight percent of a combined total amount of the copper and manganese in the copper-manganese alloy and therefore sufficiently near the congruent melting point of the Cu—Mn alloy system to be avoid dendritic growth during solidification of the copper-manganese alloy to avoid from microporosity in the article attributable to dendritic growth, the product comprising a cast microstructure free of dendritic growth, the article further containing manganese carbide precipitates.

According to one embodiment of the article containing a manganese content of 25 to 40 weight percent, the manganese carbide is Mn7C3.

According to one embodiment of the article containing a manganese content of 32 to 36 weight percent, the manganese carbide is Mn7C3.

According to one embodiment of the article containing a manganese content of 25 to 40 weight percent, the article is a plumbing valve or fitting.

According to one embodiment of the article containing a manganese content of 25 to 40 weight percent, the article is a propeller.

According to one embodiment of the article containing a manganese content of 32 to 36 weight percent, the article is a plumbing valve or fitting.

According to one embodiment of the article containing a manganese content of 32 to 36 weight percent, the article is a propeller.

An article is disclosed wherein the article is made from a process including forming a melt comprising copper in a melting vessel, introducing manganese into the melt to produce a copper-manganese alloy, and casting the copper-manganese alloy in a mold to form the article, wherein the carbon and oxygen contents of the copper-manganese alloy are controlled in order to control the formation of graphite, manganese carbide, and/or manganese oxide particles within the article.

According to one embodiment of the article made from the process including forming a melt comprising copper in a melting vessel, introducing manganese into the melt to produce a copper-manganese alloy, and casting the copper-manganese alloy in a mold to form the article, wherein the carbon and oxygen contents of the copper-manganese alloy are controlled in order to control the formation of graphite, manganese carbide, and/or manganese oxide particles within the article, the article contains manganese carbide precipitates.

According to one embodiment of the article made from the process including forming a melt comprising copper in a melting vessel, introducing manganese into the melt to produce a copper-manganese alloy, and casting the copper-manganese alloy in a mold to form the article, wherein the carbon and oxygen contents of the copper-manganese alloy are controlled in order to control the formation of graphite, manganese carbide, and/or manganese oxide particles within the article, the article contains Mn7C3.

A copper-manganese alloy containing copper and manganese in amounts at or sufficiently near the congruent melting point of the Cu—Mn alloy system to sufficiently avoid dendritic growth during solidification of the copper-manganese alloy to avoid the formation of microporosity attributable to dendritic growth and an amount of carbon sufficient to form manganese carbide precipitates during solidification of the copper-manganese alloy.

According to one embodiment of the alloy, the copper manganese alloy containing copper and manganese in amounts at or sufficiently near the congruent melting point of the Cu—Mn alloy system to sufficiently avoid dendritic growth during solidification of the copper-manganese alloy to avoid the formation of microporosity attributable to dendritic growth and an amount of carbon sufficient to form manganese carbide precipitates during solidification of the copper-manganese alloy, the copper-manganese alloy contains at least 25 weight percent and not more than 40 weight percent manganese.

According to one embodiment of the alloy, the copper manganese alloy containing copper and manganese in amounts at or sufficiently near the congruent melting point of the Cu—Mn alloy system to sufficiently avoid dendritic growth during solidification of the copper-manganese alloy to avoid the formation of microporosity attributable to dendritic growth and an amount of carbon sufficient to form manganese carbide precipitates during solidification of the copper-manganese alloy, the copper-manganese alloy contains at least 32 weight percent and not more than 36 weight percent manganese.

According to one embodiment of the alloy, the copper manganese alloy containing copper and manganese in amounts at or sufficiently near the congruent melting point of the Cu—Mn alloy system to sufficiently avoid dendritic growth during solidification of the copper-manganese alloy to avoid the formation of microporosity attributable to dendritic growth and an amount of carbon sufficient to form manganese carbide precipitates during solidification of the copper-manganese alloy, the copper-manganese alloy contains at least 25 weight percent and not more than 40 weight percent manganese, and the carbon content is derived from a melting vessel used to melt the copper-manganese alloy.

A wrought article made of a copper-manganese alloy is disclosed. The article contains an amount of manganese that is at least 25 weight percent and not more than 40 weight percent of a combined total amount of the copper and manganese in the copper-manganese alloy and therefore sufficiently near the congruent melting point of the Cu—Mn alloy system to avoid dendritic growth during solidification of the copper-manganese alloy to avoid microporosity attributable to dendritic growth in the cast form, and manganese carbide precipitates.

According to one embodiment the wrought article is plumbing valve or fitting.

According to one embodiment the wrought article is a propeller.

According to one embodiment, the wrought article contains $Mn_7C_3$ precipitates.

According to one embodiment the wrought article containing $Mn_7C_3$ precipitates is a plumbing valve or fitting.

According to one embodiment the wrought article containing Mn7C3 precipitates is a propeller.

According to one embodiment an article is disclosed which is wrought from a cast article made from a method that includes forming a melt containing copper in a melting vessel, introducing manganese into the melt to produce a copper-manganese alloy, and casting the copper-manganese alloy in a mold to form the article, wherein the carbon and oxygen contents of the copper-manganese alloy are controlled in order to control the formation of graphite, manganese carbide, and/or manganese oxide particles within the article.

According to one embodiment, an article is disclosed which is wrought from a cast article made from a method that includes forming a melt containing copper in a melting vessel, introducing manganese into the melt to produce a copper-manganese alloy, and casting the copper-manganese alloy in a mold to form the article, wherein the carbon and oxygen contents of the copper-manganese alloy are controlled in order to control the formation of graphite, manganese carbide, and/or manganese oxide particles within the article, wherein the article is a plumbing valve or fitting.

According to one embodiment, an article is disclosed which is wrought from a cast article made from a method that includes forming a melt containing copper in a melting vessel, introducing manganese into the melt to produce a copper-manganese alloy, and casting the copper-manganese alloy in a mold to form the article, wherein the carbon and oxygen contents of the copper-manganese alloy are controlled in order to control the formation of graphite, manganese carbide, and/or manganese oxide particles within the article, wherein the article is a propeller.

BRIEF DESCRIPTION OF DRAWINGS

While some of the figures shown herein may have been generated from scaled drawings or from photographs that are scalable, it is understood that such relative scaling within a figure are by way of example, and are not to be construed as limiting.

FIGS. 5(A) and 5(B) are scanned images of micrographs showing $Mn_7C_3$ precipitates identified in Cu—Mn alloys made using clay-graphite crucible.

FIGS. 6 (A) and 6(B) are scanned images of micrographs of a Cu—Mn alloy exhibiting evidence of completely cellular growth during solidification.

DETAILED DESCRIPTION

Figure 1:
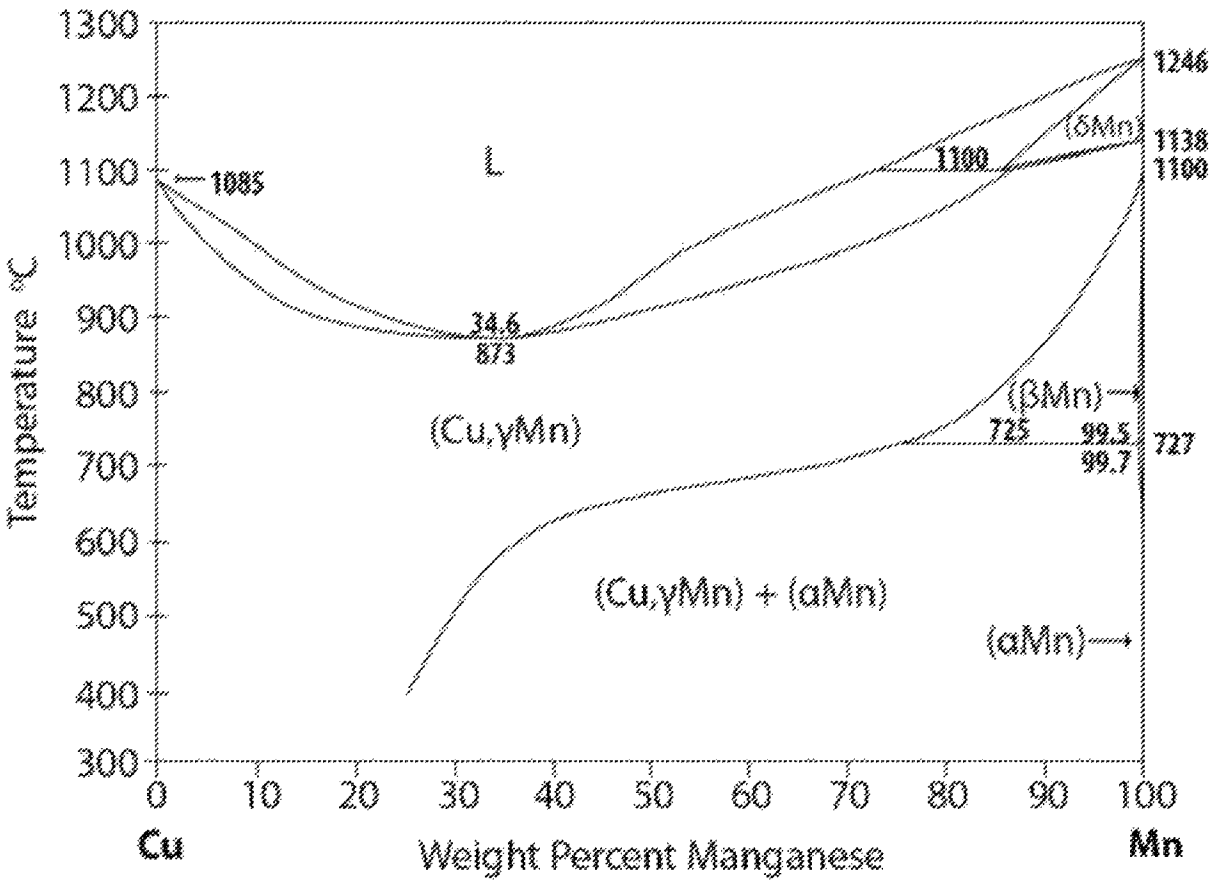
FIG. 1 is a representation of the equilibrium phase diagram of the binary Cu—Mn system.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would normally occur to one skilled in the art to which the disclosure relates.

The present invention provides a class of copper-manganese alloys based around the congruent melting composition of the Cu—Mn binary system, which is believed to be 34.6+/−1.4 weight percent (about 38+/−2 atomic percent) manganese and has a melting temperature of about 870° C. In preferred embodiments, the copper-manganese alloys are lead-free, offer high castability for shape casting, and contain sufficiently minimal chemical segregation and microporosity when cast to eliminate the need for lead or other elements to fill the microporosity.

Copper casting alloys are commonly divided into three groups based on their freezing range and resulting castability. Group 1 alloys, having freezing ranges less than 50 degrees C., include high coppers, brasses and aluminum bronzes. These alloys are generally considered to have the highest castability from the standpoint of microporosity due to dendritic solidification. Group 2 alloys have solidification ranges from 50 to 110 degrees C. and Group 3 alloys larger ranges. Group 3 alloys include the leaded brasses and tin bronzes, in which the lower melting alloying elements maintain the presence of liquid down to low temperatures during solidification, resulting in the most profuse dendritic solidification and poor soundness/tightness. Even with the use of chills, pressure tightness is often problematic in castings of the wide solidification range alloys.

FIG. 1 is a representation of the Cu—Mn binary phase diagram. A shown in FIG. 1, the Cu—Mn system exhibits a congruent liquid-solid equilibrium (congruent point) at 34.6 weight percent Mn and 873 degrees C., for which solidification occurs without change in composition or temperature (no freezing range), as in the case of a pure metal. An alloy of the congruent composition may thus exhibit partition-less solidification under equilibrium conditions at a melting point, with a planar solidification front and the associated castability of a pure metal, but in an alloy of high solute concentration. Furthermore, the congruent minimum is so shallow and the freezing range near it so narrow (less than one degree C.) that small variations in alloy composition about the congruent composition may not cause significant deviations from this ideal behavior. On the other hand, very small temperature/composition ranges are sufficient to drive interface breakdown and cellular solidification under typical casting conditions. Indeed under typical casting conditions essentially all commercial alloys are dendritic and even commercially pure copper (99.9% copper) C110 exhibits a fully dendritic cast microstructure.

In investigations leading to the present invention, over thirty different heats of nominally 1 to 2 kg in mass were prepared by crucible melting in air. The target composition for most of the heats was the Cu—Mn congruent point of 34.6 weight percent Mn. The copper was first melted in a No. 2 clay-graphite crucible in a 15 kW push-out induction furnace (Inductotherm, SuperTrac). The copper source was clean C110 (99.9 weight percent Cu, 0.04 or less weight percent oxygen) scrap bolts and bussbar, while the manganese source was electrolytic manganese cathode chips (99.99 weight percent Mn, metallic). The copper was melted and superheated to about 1200 degrees C. with a disk of graphite floating on the surface for deoxidation. The Mn was alloyed in two approximately equal portions by pouring the Mn chips onto the molten copper and submerging the chips under the surface with a graphite rod with continued heating. The graphite disk was placed back on top of the melt and heating was continued at full power. Once fully alloyed (about 10 min), the melt was skimmed and poured at about 1200 degrees C., as measured using an optical pyrometer. A mold made of steel was utilized to cast cylindrical ingots having a diameter of 2.5 cm and height of 10 cm. Later investigations utilized other crucible materials and melting practices, the additional details of which are described with those results hereinafter.

Ingot sections were prepared for microscopy by abrasive saw cutting, grinding on silicon carbide paper through 600 grit, diamond polishing and final polishing with 0.05 micrometer alumina slurry on napped cloth. The samples were observed by optical microscopy in the unetched and etched condition. The etchant was a solution of 25 g iron (III) chloride, 25 ml concentrated hydrochloric acid and 100 ml deionized water. Field emission scanning electron microscopy (FE-SEM) was conducted in an FEI XL40 with an accelerating voltage of 20 keV. Energy-dispersive X-ray spectroscopy (EDS) using a thin window detector (EDAX™ ESEM 2020) capable of measuring carbon and oxygen was also conducted in the FE-SEM. An accelerating voltage of 15 keV was used for point analyses of second phases, in order to minimize the interaction volume, whereas 20 keV was used for area analyses of overall alloy composition. Quantification was done via internal standards through the EDAX program with calibrated Standard Element Coefficients (SEC). Both point (about one micrometer) and area (about 200×300 micrometer analyses were performed. Area analysis was used for a better measure of overall alloy composition and radial profiles of the ingots were measured to explore macrosegregation.

Mechanical properties were evaluated by Vickers hardness testing using a LECO LV-100 tester, with a 30 kg load. Samples for hardness testing were cut transversely from the cylindrical ingots into one centimeter thick sections and ground through 600 grit SiC paper before testing. Each sample was tested fifteen times and the results are reported as the mean+/−standard deviation. Hardness tests also were performed in the same manner on several common commercial alloys for comparison. Tensile testing was conducted following American Society for Testing and Materials (ASTM) E-8 standards.

Test bars were cast separately in a cast iron mold. The tensile specimens had a gage section diameter of about 1.3 cm and the strain was measure using an extensometer over a gage length of 5 cm. The testing was conducted on a screw-driven MTS Insight™ test frame with a 100 kN load cell at a cross-head rate of one mm/min. The bars were cast and ground to the finish and geometry prescribed by the standard.

Figure 2:
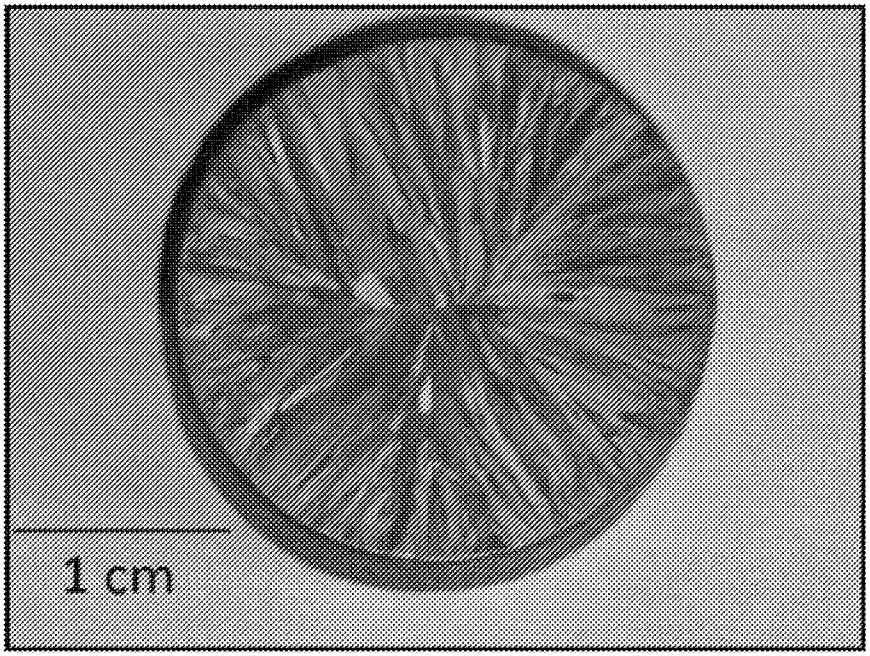
FIG. 2 is a scanned image of a microphotograph of a section of an ingot produced from the melt in a clay-graphite crucible.

In a first investigation, samples were melted in clay-graphite crucibles. The temperature of melting was approximately 1200 degrees C. Ingots produced by this melting process were examined for their microstructure. FIG. 2 is a scanned image of a microphotograph of a section of an ingot produced from a Cu—Mn melt in a clay-graphite crucible. Referring to FIG. 2, the Cu—Mn alloy shows an overall cast structure with a completely columnar grain structure. Small amounts of centerline porosity were occasionally observed near a vertical center of the ingots. Observations on many cross-sections from the ingot of FIG. 2 and other ingots cast from other heats prepared by the same method did not reveal any microporosity. In this disclosure, the term microporosity is used to describe porosity attributable to dendritic growth. Avoiding microporosity or having a low microporosity is intended to mean microporosity less than typically 1%. This number as a limit for the low porosity may vary depending on solidification conditions and compositions. The low microporosity was an important distinguishing attribute of this alloy. Microposroisty is commonly understood by those skilled in the art to be of the order of dendrite spacing, typically in 1-100 micrometers range.

Figure 3:
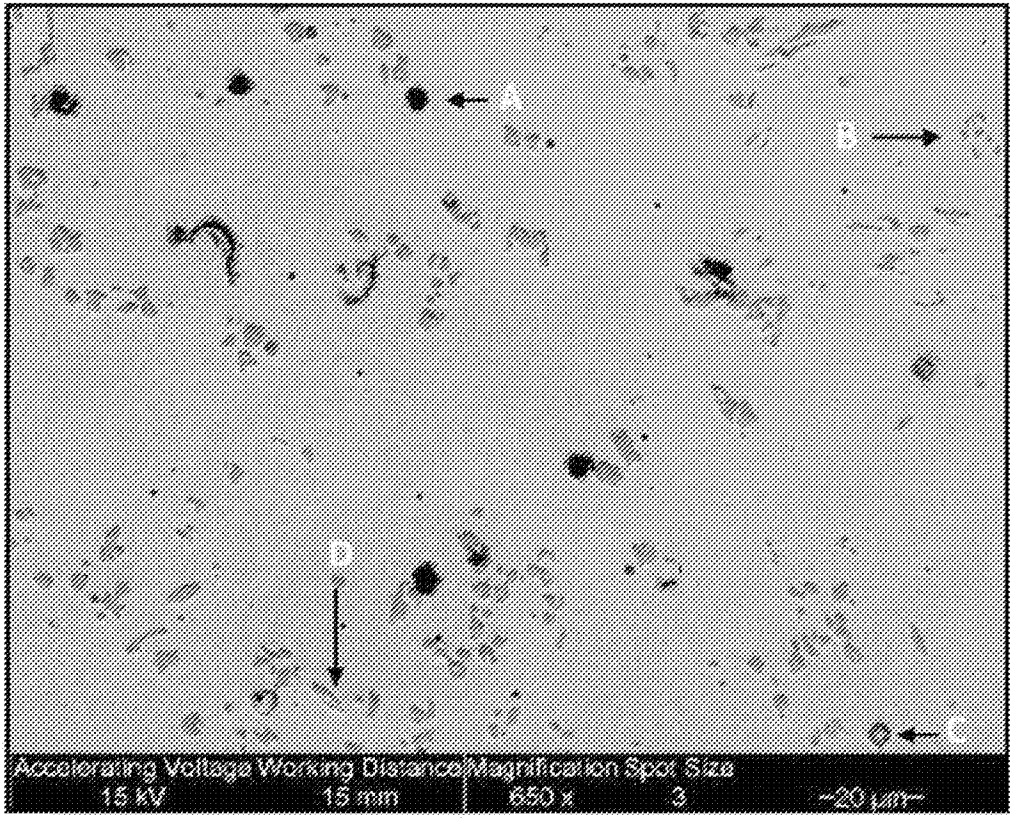
FIG. 3 is a scanned image of a micrograph of a Cu—Mn alloy that shows carbides and other second phases present in the alloy.

FIG. 3 is a scanned image of an optical micrograph of a Cu—Mn alloy that shows carbides and other second phases present in the alloy. Referring to FIG. 3, optical microscopy of the Cu—Mn ingot sections of FIG. 2 at higher magnifications, revealed the presence of a considerable amount of second phase particles present throughout the ingot. Closer examination showed four different types of particles, typical examples of which are labeled A through D in FIG. 3. Dark nodules, labeled A in FIG. 3, were about five micrometers in size and were identified as graphite, similar to particles typically found in ductile (spheroidal graphite) cast iron. Glassy beads, labeled C in FIG. 3, were about five micrometers in size and primarily consisted of silica. Both of these phases are believed to primarily come from the crucible as impurities. The remaining phases, labeled as B and D in FIG. 3, were identified as $Mn_7C_3$.

Figures 4A, 4B, 4C, 4D:
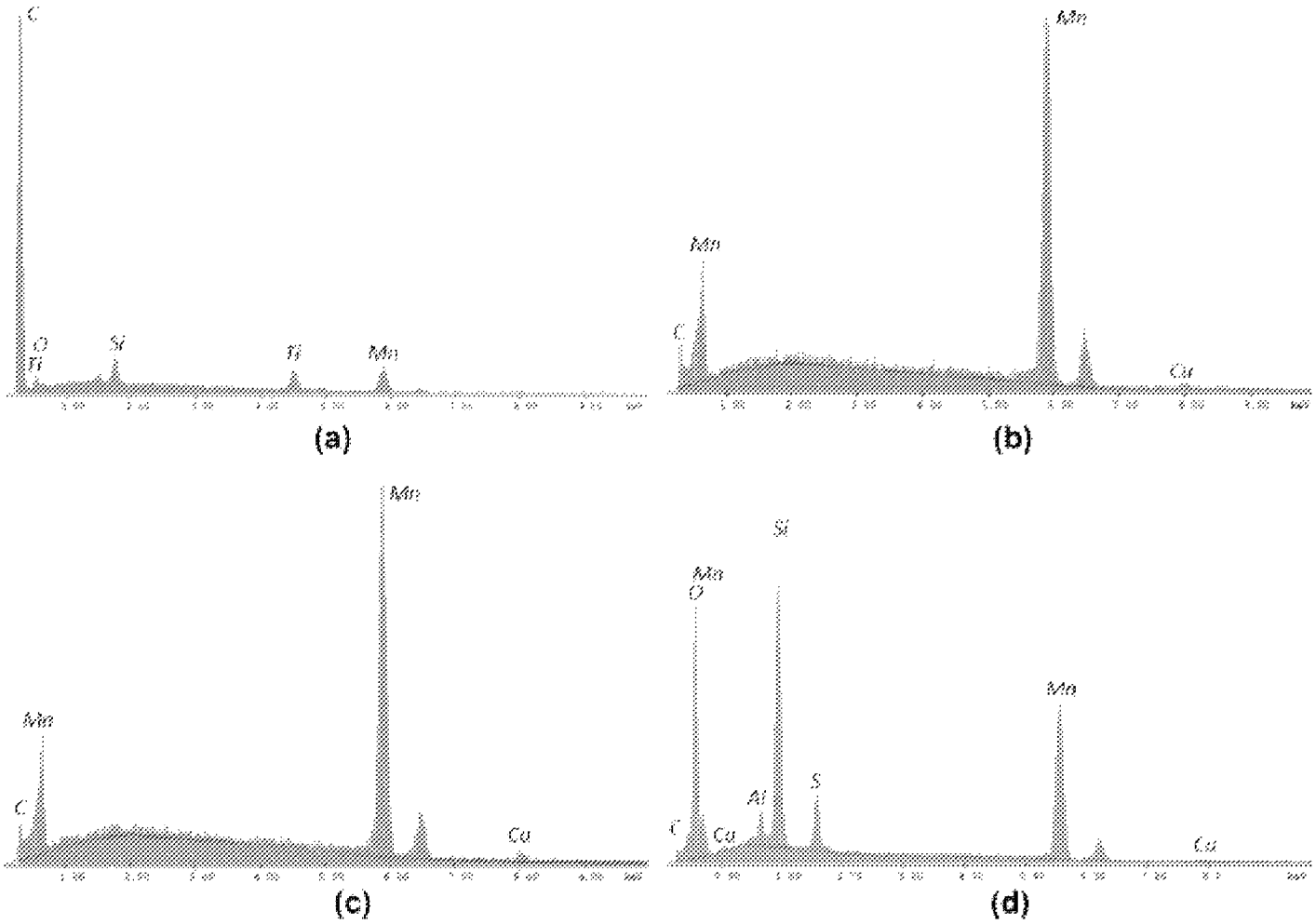
FIGS. 4(*a*)-4(*d*) show representations of the energy dispersive X-ray spectroscopy (EDS) spectra of precipitates shown in FIG. 3.

FIGS. 4(*a*)-4(*d*) are representations of the EDS (Energy Dispersive X-ray Spectroscopy) spectra showing the compositions of the second phase particles A, B, C and D shown in FIG. 3 respectively. These spectra were utilized to identify the chemical nature of the particles A.B, C and D described above.

FIGS. 5(A) and 5(B) are scanned images of micrographs showing $Mn_7C_3$ precipitates identified in Cu—Mn alloys made using clay-graphite crucible. Refereeing to FIG. 5, $Mn_7C_3$ appeared to have two morphologies, one that was observed as angular, as represented in FIG. 5(A), and the other globular, as represented in FIG. 5(B). The angular structure showed a high aspect ratio of length to width and formed to lengths of 40 micrometers. The globular carbide was found to form freely in the matrix, as well as on graphite nodules that appeared throughout the matrix, as represented in FIG. 5(B).

Although the Cu—Mn phase diagram predicts the separation of the essentially pure manganese phase under equilibrium cooling in the solid state, this transformation is known to be very sluggish, perhaps suggesting why separation was not observed in the as-cast microstructure of the ingots.

FIGS. 6 (A) and 6(B) are scanned images of micrographs of a Cu—Mn alloy exhibiting completely cellular growth during solidification. Referring to FIG. 6(A), the solidification morphology after etching showed a distinct cellular structure throughout the outer portion of the cross section of the ingot of FIG. 2. FIG. 6(B) shows a closer view of the cells in an individual grain of the alloy exhibiting cellular growth during solidification. The cellular structure was very fine with an average cell spacing of 20 micrometers. Near the center of the ingot cross-sections, the grain morphology exhibited a transition from cellular to dendritic-cellular. The transition was observed on average about 75 percent of the way from the surface to the center of the ingot, that is, from the circumference to the center of the cross-sections. Such a transition is believed to be a consequence of the ratio ($G_L/V$) of decreasing liquid temperature gradient ($G_L$) to growth velocity as the solidification proceeds directionally inward from the exterior surface of the ingot. The growth instability and formation of the cellular structure may be attributed to the alloy composition being shifted off the Cu—Mn congruent point and/or other contaminants, as discussed in detail hereinafter.

Figure 7:
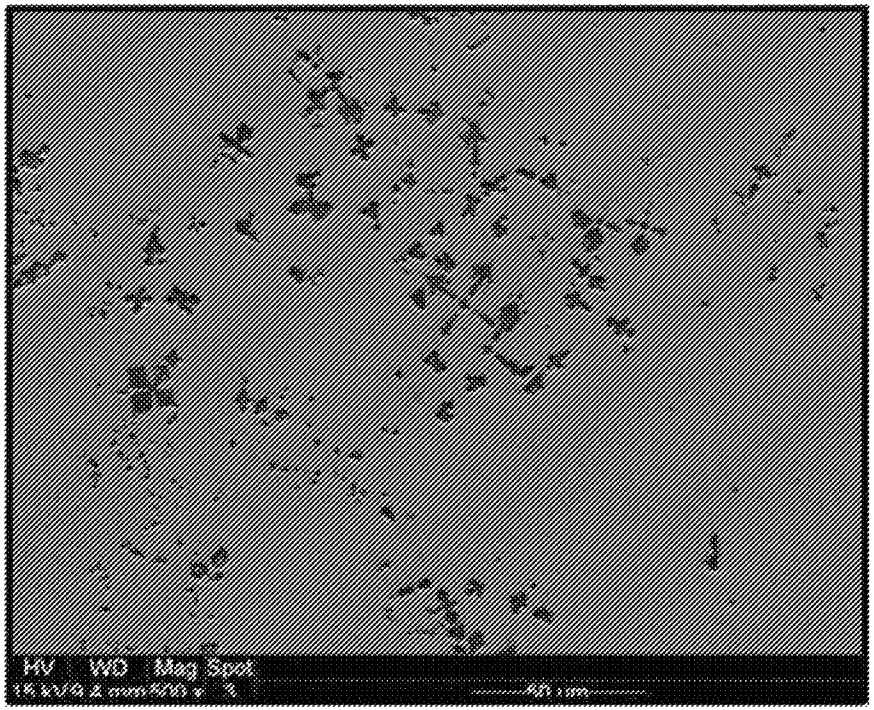
FIG. 7 is a scanned image of a micrograph of unetched Cu-35 Mn alloy melted in an alumina crucible showing dendritic growth morphology of manganese oxide particles.

In a second investigation, in order to preclude carbon, the alloy was prepared in a fused alumina crucible (Zircoa, Cleveland, Ohio), using the same procedure as in the clay-graphite crucibles. The temperature of melting was approximately 12oo degrees C. Initially, copper was melted with a graphite disk floating on top of the melt for deoxidation; however, after alloying with Mn the graphite disk was not returned to the top of the melt and no carbon was in contact with the melt. The alloy melt was more drossy than in the clay-graphite crucibles. The resulting ingots contained about one volume percent of 5-15 micrometer size manganese oxide particles, as identified by EDS. FIG. 7 is a scanned image of a micrograph of unetched Cu-35 Mn alloy melted in an alumina crucible showing dendritic growth morphology of the manganese oxide particles. The observed dendritic morphology indicates that the ingots crystallized in the melt upon cooling. This result is believed to suggest that carbon in solution in the melts prepared in contact with graphite maintains a lower oxygen concentration than the Mn alone. This conclusion is based on the belief that without carbon in solution the melt would be saturated with oxygen in equilibrium with MnO (on the surface of the melt). Upon cooling, the melt would become supersaturated with oxygen prior to solidification, resulting in the nucleation and (dendritic) growth of the MnO particles. These particles were heterogeneously distributed in the ingots, with some sections containing a few particles and other areas containing clusters of the particles. A potent deoxidizer (e.g., Al) would suppress the formation of MnO under these conditions.

In a third investigation, a No. 2 SiC crucible (Vesuvius, London, UK) was selected as having a carbon content that was intermediate between the clay-graphite and alumina crucibles. Specifically, the SiC carbide crucible contained nominally about 30 percent carbon according to the manufacturer's specification. Heats were prepared in the same manner as the alumina crucibles, that is, without contact with the graphite disk on top of the melt after alloying the Cu with the Mn. The melt temperature in this case was approximately 1200 degrees C. The resulting microstructure exhibited a very small amount of second phase particles which were observed to be less than one micrometer in size and widely dispersed. Microanalysis was used to identify the particles as the Mn carbide, but the small size of the particles made quantification difficult. Based on morphological features discussed in more detail hereinafter, these fine Mn carbides were hypothesized to form in the solid state after solidification. The SiC crucible is believed to provide enough carbon to avoid Mn oxide precipitation during solidification while limiting $Mn_7C_3$ and graphite formation for a clean microstructure.

Figure 8:
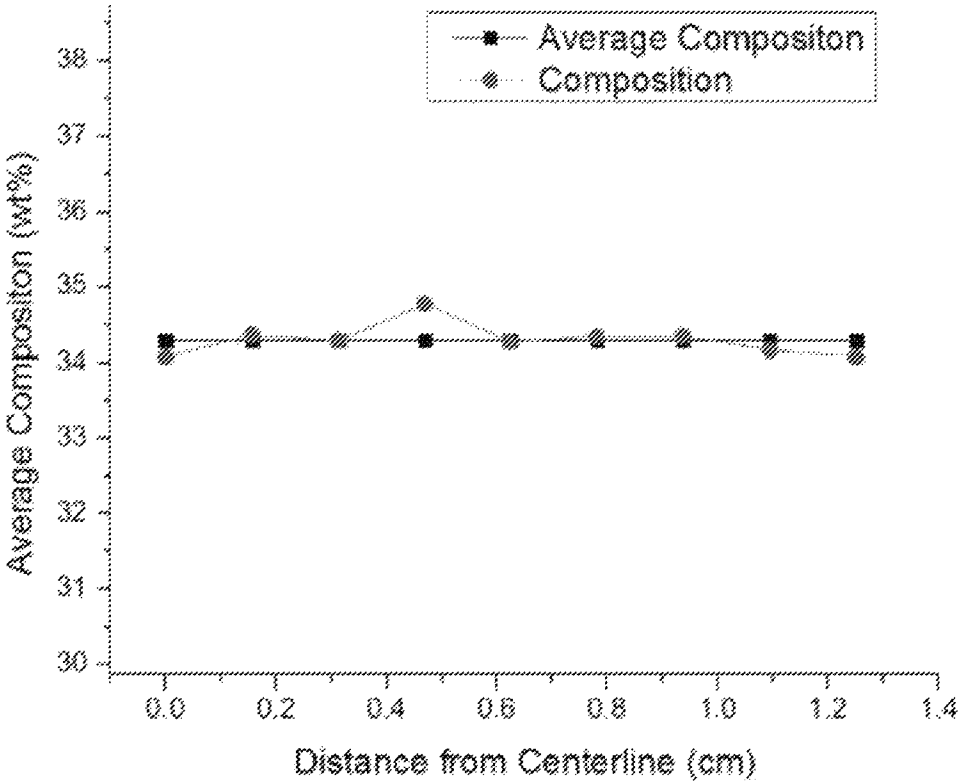
FIG. 8 is a representation of a profile of the average composition of a Cu—Mn alloy along with a representation of composition profile from the center of the casting to an outer edge.

The composition of the ingot made of Cu—Mn alloy using silicon carbide (SiC) crucible was measured on a cross-section using small area (about 200×300 micrometer) EDS analysis. In this case, a radial profile was measured in nine evenly spaced locations starting from the centerline to the perimeter surface of the cross-section. FIG. 8 is a representation of a profile of the average composition of a Cu—Mn alloy along with a representation of composition profile from the center of the casting to an outer edge. The composition varied from 34.1 to 34.8 weight percent Mn and the average of the measurements was 34.3+/−0.2 percent Mn. The data indicates very little deviation in concentration profile and a relatively small preferential loss of Mn overall due to oxidation relative to the charge composition of 34.6 weight percent Mn.

Figures 9A, 9B:
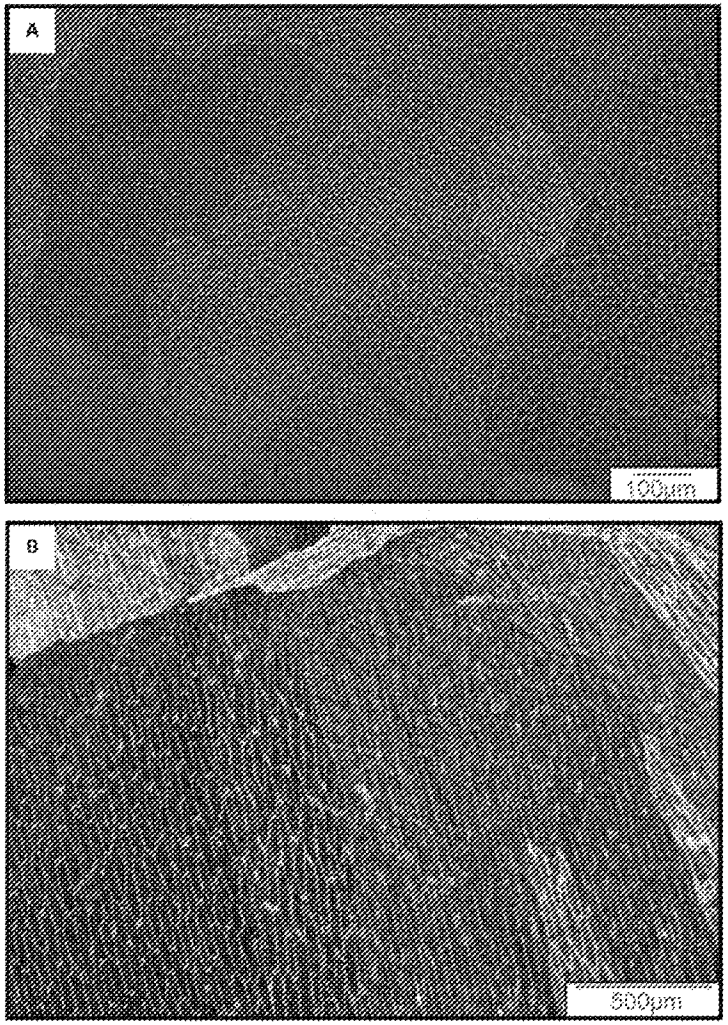
FIGS. 9(*a*) and 9(*b*) are optical images of polished and etched low-carbon Cu-35 Mn alloy prepared in SiC crucible.

FIGS. 9(*a*) and 9(*b*) are optical images of polished and etched low-carbon Cu-35 Mn alloy prepared in SiC crucible. Referring to FIG. 9(*a*), observation of the resulting microstructure of a cross section of a sample of this alloy after etching revealed cellular solidification morphology from the surface to the center of the ingot and axial direction. Referring to FIG. 9(*b*), cellular structure is seen near surface viewing in radial direction. Compared to the heats melted in clay-graphite crucible, the cellular structure was maintained all the way to the center of the ingot cross-section. Several other heats were prepared under identical conditions in SiC crucibles which also resulted in entirely cellular structures. Similar to the microstructure represented in FIG. 6(B), the average cell size measured about 20 micrometers, indicating a high aspect ratio of about 500.

In a fourth investigation, several heats of the congruent composition target, 34.6 weight percent Mn, were prepared in clay-graphite crucibles at lower temperatures, with and without the graphite disk floating on the surface after alloying with Mn and heating to about 1200 degrees C. The results showed that the carbide formation could be suppressed in the clay-graphite crucible by not using the graphite disk on top of the melt after alloying with the Mn. Microstructure analysis also did not reveal any MnO as formed in the alumina crucible. Similar results were obtained when the melt temperature was limited to about 1000 degrees C. in the clay-graphite crucible, even with the graphite disk in contact with the top of the melt before and after alloying with Mn. These results indicate that the carbon contamination may be temperature and time dependent in the range of common superheats for casting. Thus, the carbide formation can be controlled in clay-graphite crucible melting of the Cu—Mn alloys of congruent melting composition.

Having reduced Mn loss from the melt due to carbide formation to low levels, the sensitivity of solidification growth morphology to composition near the congruent point was next addressed systematically. In order to investigate the composition dependence of the growth morphology and possibly more closely identify the congruent point, a heat was prepared with target composition of 37 weight percent Mn and sequentially diluted with copper in target steps of nominally one weight percent down to 32 weight percent Mn. A small portion of the heat was cast from each dilution step into a 12.7 mm diameter cylindrical steel mold. The target composition range was chosen with the congruent point composition of Goken as the median. The results of this investigation are shown in Table 1 below. The change in composition was observed to lead to a varying degree of cellular morphology, with alloys at the maximum and minimum of the tested composition range showing primarily dendritic solidification, while alloys in the center remained completely cellular through solidification.

TABLE 1

Fraction (radial) cellular microstructure measured on ingot cross sections.

| Alloy composition (wt. % Mn) | Fraction Cellular |
|---|---|
| 35.7 | all cellular |
| 34.2* | all cellular |
| 32.8 | all cellular |
| 30.7 | ⅞ |
| 27 | ¼ |

*From larger ingot (25 mm diameter); more stringent cooling conditions (slower) for avoiding dendritic transition.

Vickers hardness values measured for the Cu—Mn alloys discussed herein are listed in Table 2 along with hardness values for commercially available alloys for comparison. The Vickers and Brinell hardness values, HV and HB respectively, were converted (values in parentheses) directly from ASTM hardness conversion tables for cartridge brass. Hardness of the near-congruent Cu—Mn alloys containing only a trace of manganese carbide, as prepared in SiC crucibles, measured 100+/−5.2 HV. The alloy containing manganese carbides measured 120+/−4.1 HV. The higher hardness of the alloy containing manganese carbides may be due to the presence of the hard carbides. The small amount of manganese that goes to carbide formation does not significantly reduce the manganese concentration of the matrix, as discussed in more detail hereinafter.

TABLE 2

Hardness measurements and comparison values from the literature

| Alloy | HV (kg/mm$^2$)* | Source |
|---|---|---|
| Cu—35Mn | 93 +/− 4.1 | This study |
| Cu—35Mn carbide-containing | 111 +/− 1.9 | This study |
| C857 (63-1Sn—1Pb—35Zn) yellow brass | 83 | ASM |
| C932 (83-7Sn—7Pb—3Zn) bearing bronze | 73 | ASM |
| C836 (85-5Sn—5Pb—5Zn) red brass | 65 | ASM |
| C875 (82-4Si—14Zn) | | |
| C110 (recast) | 56 +/− 1.6 | This study |

*Commercial alloy values from Metals Handbook, converted from Brinell (500 kg) values using ASTM hardness scale conversions tables for Cartridge Brass.

Preliminary tensile testing of the low-carbide alloy using cast-to-size test bars resulted in a yield strength=182+/−6 MPa, tensile strength=286+/−37 MPa and ductility, % EL=22+/−4. The observed yield strength value was about 50 percent higher than the reported values for C836 and C932, CDA designations of copper, which is believed to be due to the higher total content of alloying elements other than copper.

A distinguishing characteristic of the near-congruent Cu—Mn alloys observed in the above-mentioned investigations is the cellular solidification microstructure which exhibited a distinct lack of microporosity. Indeed, none of the metallographic sections from the many different heats of the alloy cast in the investigations leading to this invention showed any significant microporosity attributable to solidification shrinkage. Cellular growth is usually obtained only in specially controlled unidirectional solidification experiments. A cellular structure is believed to be highly advantageous in casting due to a reduction or elimination of the defects associated with dendritic solidification, including microporosity, microsegregation, and hot-tearing. These benefits are all the more unusual and unexpected in a high concentration alloy.

The key result observed in the investigations discussed above was that completely cellular structures were obtained for alloys within about two weight percent Mn of the congruent composition. Greater deviations from the congruent composition resulted initially in cellular growth, transitioning to mildly dendritic toward the center of the ingots, with a shallower depth of transition for increasing deviation from the congruent composition. Although the cellular-to-dendritic transition depends on the particular cooling conditions, as well as the solutal undercooling, the directly measured compositional tolerance appeared to be quite commercially practical. Furthermore, no mircroporosity was observed in the mildly dendritic structures near the transition. Quantitative prediction of the cellular-to-dendritic transition, even approximately, may be difficult. Nevertheless, the composition tolerance for avoiding microporosity associated with dendritic solidification was effectively wider than that for the first appearance of dendritic features, that is, it is believed that mildly dendritic alloys that are slightly beyond the transition from cellular do not have enough dendritic structure to result in microporosity.

Although a majority of the benefits of non-dendritic growth are realized in cellular growth, achieving planar growth in the near-congruent Cu—Mn alloys under typical casting conditions may be even more desirable. The general form of the constitutional supercooling (CS) criterion for predicting the onset of non-planar (cellular) growth depending on process conditions is:

$$\frac{G_L}{V} = \frac{\Delta T}{D_L}$$

where $G_L$ is the temperature gradient in the liquid near the solid-liquid interface, V is the growth velocity, ΔT is the liquidus-solidus temperature range and $D_L$ is the diffusivity in the liquid. Planar growth normally requires a low velocity and a high temperature gradient, as well as very small freezing ranges. Following Kurz et al., "Fundamentals of Solidification," 3rd Edition, 1989, $G_L$ and V are coupled in casting according to the cooling conditions and $G_L/V$ changes with time during casting from approximately 20 to 0.2 Ks/mm$^2$ Estimating DL=0.005 mm$^2$/s, the critical ΔT varies from 0.1 to 0.001 K, consistent with the general observations herein that only slight freezing ranges are required to set up non-planar solidification under typical casting conditions. An early investigation testing the CS criterion in dilute Sn—Pb alloys showed that about 0.01 weight percent Pb was sufficient to require $G_L/V$ greater than about 100 Ks/mm$^2$ in order to maintain planar growth in controlled directional solidification experiments.

Considering the low curvature of the liquidus and solidus at the congruent point, narrow freezing ranges are expected for measureable deviations from the congruent point. A graphical estimate from the phase diagram assuming circular liquidus and solidus curves near the congruent point indicates a freezing range of about 0.0004 K for composition deviations on the order 0.1 weight percent manganese from the congruent composition. This appears to be consistent with the results of the dilution experiment (See Table 1) in which the composition increments were much larger and highly unlikely to have been close enough to the actual congruent point for planar growth.

Surprisingly, in contrast to dilute alloys, narrow freezing ranges occurred at high solute concentrations near the Cu—Mn congruent point. Another distinguishing feature of near-congruent Cu—Mn alloys was that the converging liquidus and solidus lines result in a partition coefficient, k, converging to one at the congruent point, even in the approximation of linear liquidus and solidus. This is fundamentally different from the usual case where the liquidus and solidus are diverging and k is constant in the linear approximation.

Another aspect to discuss in terms of benefits of near-congruent composition associated with the temperature aspect (as opposed to the composition, narrow freezing range) is the lower casting temperature compared to most copper alloys gives a direct advantage to fluidity in terms of smaller driving force for solidification (lower rate). Specifically, modeling suggests that the lower casting temperature may reduce the driving force for solidification by about twenty-five percent.

While the estimated Mn tolerance for maintaining planar stability is predicted to be quite small, other impurities may dominate the solutal undercooling. In this regard, carbon is believed to have both direct and indirect effects on composition variations in the alloy. Carbon dissolved in solution necessarily increases the freezing range, as well as reacts with Mn forming Mn carbides and changes the composition during solidification.

Figure 10:
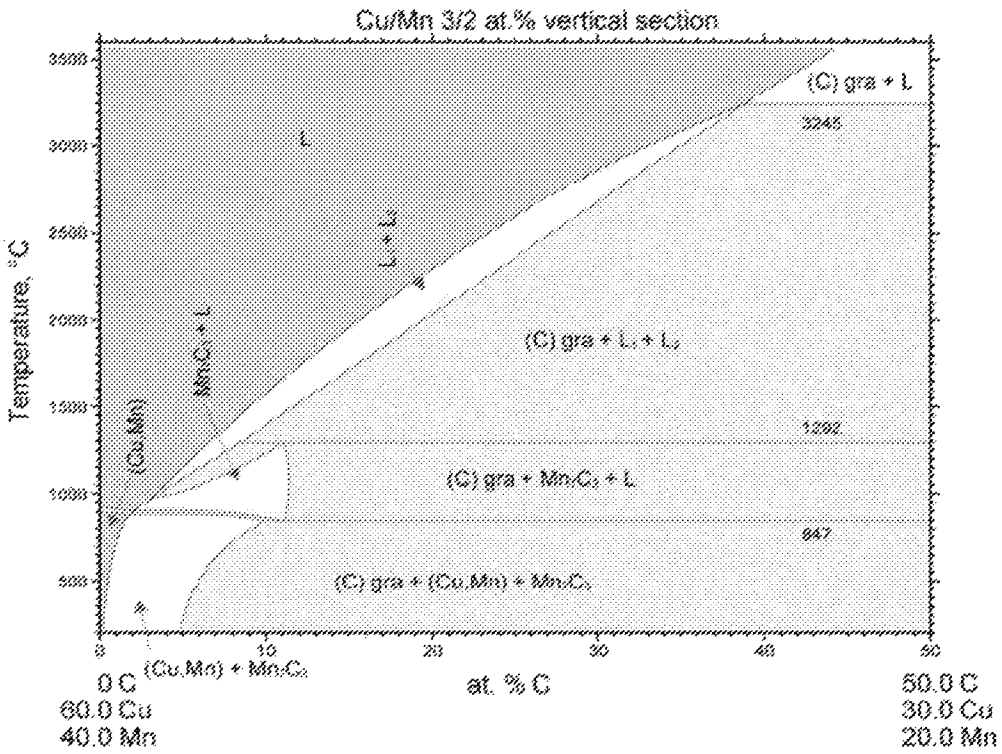
FIG. 10 is a representation of an equilibrium phase diagram of the Cu—Mn—C system.

It is known in the art that carbon has a low solubility in pure copper and an increased solubility when Mn is present in solution. At 1200 degrees C., the carbon solubility increases from 0.005 weight percent in pure Cu to about 0.5 weight percent in Cu-30 weight percent Mn. FIG. 10 is a representation of an equilibrium phase diagram of the Cu Mn—C system. (Reference: Y. A. Kocherzhinskii and O. G. Kulik, C—Cu—Mn Phase Diagram, ASM Alloy Phase Diagrams Center, P. Villars, editor-in-chief; H. Okamoto and K. Cenzual, section editors; http://www1.asminternational.org/AsmEnterprise/APD, ASM International, Materials Park, Ohio, 2013). Referring to FIG. 10. this pseudo-binary section shows the effect of adding C to a Cu—Mn alloy of 40 weight percent Mn, which is only slightly more concentrated than the congruent composition in the Cu—Mn binary of 34.6 weight percent (that is, about equal to 38 atomic percent) Mn of the investigations herein. The diagram predicts that both graphite and $Mn_7C_3$ can form in the liquid alloy, depending on the carbon concentration and temperature. This situation supports a hypothesis based on globular morphology that some of the carbides formed in the melt prior to solidification. In some cases, these carbide particles had a dendritic (flower-like) morphology.

Carbides having an angular morphology (FIGS. 3 and 5A) were also observed in the alloys prepared in clay-graphite crucibles (high carbon). Angular carbides having a similar morphology, but much smaller and less abundant, were the only carbides observed in the alloys prepared in a SiC crucible. These observations may be explained from the phase diagram, which shows a carbide solvus in the solid state. This is consistent with the lower carbon concentration in the SiC alloys.

Graphite was observed together with the carbides in some alloys (FIG. 5B). The graphite particles were always observed to be in contact, if not surrounded by the carbide phase, suggesting that the graphite formed first. The phase diagram indicates a composition range from about 3.2 to 5.5 weight percent C in which the equilibrium solidification sequence would have $Mn_7C_3$ forming first in the liquid and then together with graphite and Cu—Mn in a ternary eutectic, whereas below 3.2 weight percent C the $Mn_7C_3$ only forms in the solid state after complete solidification. This provides a possible explanation for the variable appearance of the graphite phase, as well as the morphologies of the graphite, graphite and carbide, and carbide phases observed. The different phase morphologies also support this sequence of formation, with the graphite stable at higher temperatures in the absences of the Mn carbide, although the phase selection during solidification may govern the observed sequence compared to that predicted by the equilibrium phase diagram.

The manganese carbide formation has an indirect effect on alloy composition by removing manganese from the alloy, shifting the composition during solidification. In order to gauge the magnitude of this effect, statistical point counting analysis was performed to measure the volume fraction of carbides in the microstructure. The resulting value of 2.2 volume percent total carbide corresponds to a reduction of about one weight percent Mn in the alloy before solidification, assuming the stoichiometric carbide composition $Mn_7C_3$ and that half of the carbides formed in the liquid and half in the solid after solidification, based on the morphological differences discussed previously. Microanalysis of the matrix phase showed about 2 weight percent lower Mn than the starting alloy composition, which is reasonably consistent with the carbide volume fraction analysis considering the assumptions and uncertainties in the measurement.

Cast yellow brass (C857), the closest analog commercial brass containing 35 weight percent Zn and one weight percent each of Pb and Sn, exhibits 84 HV (Table 2). Since the relative contributions of Pb and Sn are small and at least partially offsetting, this difference directly reflects the more potent solid solution strengthening effect of Mn compared to Zn.

In addition to yellow brass, the hardness values of the Cu—Mn alloys compare favorably with two other common cast alloys (Table 2), bearing bronze C932 (83-7Sn-7Pb-3Zn) and leaded red brass C360 (85-5-5-5). The higher solute content of the Cu—Mn solid solution gives a higher hardness, even without the Mn carbides, compared to the C932 and C360 alloys which have notoriously low castability.

The above investigations revealed that for the Cu—Mn system even small deviations in congruent composition can lead to enough solutal undercooling for planar instability in conventional casting. A cellular solidification morphology, rare in conventional castings, was found to be attainable with near congruent solidification over a measurable range of compositions in a Cu—Mn binary alloy. In all of the pours, there was no observable microporosity viewed in either optical microscopy or Scanning Electron Microscopy (SEM). It is believed that this lack of microporosity was due to the formation of the cellular morphology and narrow freezing range. The formation of manganese carbides and graphite were found to form in the alloy microstructure. Advantageously, the formation of these particles can be controlled through changes in crucible chemistry, temperature, and time. Through mechanical testing, manganese was found to be a potent solid solution strengthener that with little effect on the ductility and addition of carbides to the structure allowed for a further increase in strength.

Based on the above investigations and description, we now have a novel method of casting an article. The method includes the steps of providing melting vessel, forming a melt containing copper in the melting vessel, introducing manganese into the melt so that a copper-manganese alloy can form. The copper-manganese alloy formed can then be cast in a mold to form the article. In this method, it is further seen from the above description that the carbon and oxygen contents of the copper-manganese alloy can be controlled in order to control the formation of graphite, manganese carbide, and/or manganese oxide particles within the article. The temperature of the melt can be 1000 degrees C. Higher or lower temperatures than 1000 degrees C. are possible depending on the composition used and the casting conditions.

A melting vessel is a container suitable for carrying out the melting process. Non-limiting examples of melting vessels are crucibles and furnaces capable of withstanding the desired melt temperatures. The materials inside the melting vessel are heated externally or integrally within the refractory material lining in contact with the melt. Although in the embodiment we describe here melting was conducted in crucibles, other types of melting furnaces can be used to practice the invention, including electrical and gas-fired furnaces. Further, melting vessels made of materials based on alumina are suitable for use for melting processes described. Further melting vessels based on magnesia or silica are suitable. It is also possible to us melting vessels made of various combinations of materials such as alumina, magnesia, silica and other similar refractory materials. In one embodiment of this disclosure a melting vessel made of alumina-silica has been used with good results.

In the methods of making Cu—Mn alloys described in this disclosure, the manganese content can vary from 32 to 36 weight percent, as a non-limiting range.

It is clear from the above studies and description that in the method of casting an article according to the present disclosure, the melting vessel can contain carbon or can be free of carbon. In one embodiment of the disclosure, the melting vessel is a crucible made from mold material contains clay-graphite based material. In some embodiments of this disclosure, the melting vessel is an alumina-based crucible. It should be realized that the melting vessel can be made of other materials with similar properties as alumina. A non-limiting example of such a melting vessel is a crucible that is made of a magnesia-based material.

In another embodiment of the method according to this disclosure, a deoxidizer can be introduced into the melt prior to the step of casting the copper-manganese alloy.

Variations of the method described, based on the investigations detailed above can include placing or placing a graphite disk on a surface of the copper during the step of forming the melt and removing the graphite disk from the surface of the copper prior to introducing the manganese into the melt. In another embodiment of this disclosure, the graphite disk can be placed or located on a surface of the melt after introducing the manganese into the melt.

In view of the above investigation and according to an aspect of the invention, an article may be cast from a copper-manganese alloy to comprise a predetermined amount of precipitates. For example, increasing the carbon content within the melt increases the amount of graphite and/or manganese carbide precipitates, whereas decreasing the carbon content may lead to the melt being supersaturated with oxygen and, consequently, an increase in manganese oxide precipitates. Additionally, limiting the carbon and oxygen contents can provide a reduced amount of graphite, manganese carbide, and manganese oxide precipitates, resulting in an increased likelihood of an entirely cellular microstructure in the cast article. Such casting methods can be utilized to produce near-congruent copper-manganese castings having predetermined precipitate contents for a variety of applications.

The articles cast according to the methods described according to the methods disclosed in this disclosure can have applications in many areas. Non-limiting examples of castings that can be made following the methods of this disclosure are plumbing valves and fittings. Many other types of articles are possible to be made according to the methods described in this disclosure. For example, propellers for several marine applications, such as boats can be and utilizing the methods and alloys disclosed in this disclosure. Further many engine components and mechanical parts, ones can be made utilizing the methods and alloys described in this disclosure.

While the above investigations addressed controlling the content of carbon and oxygen in the alloys by utilizing crucibles of various compositions, it should be understood that aspects of the invention described herein are not limited to processes that utilize a crucible. For example, the alloys may be formed in a furnace, or other oxide-based or oxide lined vessel that is in contact with the alloy and from which carbon impurities may enter the alloy. Therefore, the carbon and oxygen content of a Cu—Mn alloy may be controlled by utilizing, for example, an oxide lined induction furnace comprising an oxide lining of a desired composition.

In addition, while the above investigations produced the Cu—Mn alloys starting from a pure copper melt, it is foreseeable that the starting alloy may comprise elements other than copper. For example, the starting melt may be formed by melting a preformed ingot formed of, for example, a Cu—Mn alloy comprising 30 weight percent Mn. The process could then involve heating the alloy to form a melt and then introducing manganese into the melt in order to make fine compositions adjustments before casting to make an article.

It is believed that dendritic growth in a Cu—Mn casting can be avoided in these alloys and castings by limiting the manganese content of the copper alloy to levels of at least 32 weight percent to not more than 36 weight percent, and that manganese contents below 32 weight percent and above 36 weight percent would undesirably lead to dendritic growth as well as chemical segregation and microporosity associated therewith in copper alloys. While a range of at least 32 weight percent to not more than 36 weight percent is believed to be preferred, more broadly the invention can encompass manganese contents that sufficiently, though not necessarily completely, avoid dendritic growth during solidification to avoid microporosity that would form as a result of dendritic growth. For this purpose, it is believed that manganese contents of as low as 25 weight percent and as high as 40 weight percent may be tolerable.

Another embodiment of this disclosure evident from the description above is a copper-manganese alloy containing copper and manganese in amounts at or sufficiently near the congruent melting point of the Cu—Mn alloy system to sufficiently avoid dendritic growth during solidification of the copper-manganese alloy to avoid the formation of microporosity attributable to dendritic growth and an amount of carbon sufficient to form manganese carbide precipitates during solidification of the copper-manganese alloy. In one embodiment of the copper-manganese alloy containing carbon sufficient to form manganese carbide precipitates, the copper-manganese alloys contains manganese in the range of 25-40 weight percent. In yet another embodiment of this disclosure of a copper-manganese alloy containing carbon, manganese is in the range of 32-36 weight percent.

Articles cast according to the methods and compositions of this disclosure, can be wrought (by hot working, forging, etc.). The wrought forms of the articles are called wrought articles. Thus an embodiment of this disclosure is a wrought article made of a copper-manganese alloy containing an amount of manganese that is at least 25 weight percent and not more than 40 weight percent of a combined total amount of the copper and manganese in the copper-manganese alloy and therefore sufficiently near the congruent melting point of the Cu—Mn alloy system to avoid dendritic growth during solidification of the copper-manganese alloy to avoid microporosity attributable to dendritic growth, the article comprising a cast microstructure free of dendritic growth; and further containing manganese carbide precipitates. From the above descriptions, it is clear that wrought articles containing manganese carbide precipitates, a non-limiting example of which is $Mn_7C_3$, can have manganese content in the range 32 to 36 weight percent.

The articles cast according to the methods described according to the methods disclosed in this disclosure can be further wrought (i.e. that is worked by well-known methods such as hot working, forging etc.) and the wrought articles can have applications in many areas. Non-limiting examples of wrought forms of the castings described in this disclosure include plumbing valves and fittings. Many other types of wrought articles are possible to be made according to the methods described in this disclosure.

While this disclosure describes specific embodiments, it is apparent that other forms could be adopted by one skilled in the art. For example, processing parameters such as the casting materials, temperatures, and times could be modified depending on the desired composition of the copper-manganese alloy. The methods and alloys described herein may further be used to formed wrought articles. Accordingly, it should be understood that the invention is not limited to the specific embodiments illustrated in the Figures. It should also be understood that the phraseology and terminology employed above are for the purpose of disclosing the illustrated embodiments, and do not necessarily serve as limitations to the scope of the disclosure. Thus, the implementations should not be limited to the particular limitations described. Other implementations may be possible. It is therefore intended that the foregoing detailed description be regarded as illustrative rather than limiting.

Thus, the implementations should not be limited to the particular limitations described. Other implementations may be possible. It is therefore intended that the foregoing detailed description be regarded as illustrative rather than limiting. Thus, this disclosure is limited only by the following claims.

The invention claimed is:

1. An article made of a copper-manganese alloy comprising:

an amount of manganese that is at least 32 weight percent and not more than 36 weight percent of a combined total amount of copper and manganese in the copper-manganese alloy having a melting temperature range of a Cu—Mn alloy system capable of avoiding or reducing dendritic growth during solidification of the copper-manganese alloy, compared to dendritic growth during solidification of a copper-manganese alloy containing less than 32 weight percent manganese, to avoid microporosity attributable to dendritic growth, the article comprising a cast microstructure either free of dendritic growth or containing a combination of cellular growth and dendritic growth; and comprising manganese carbide precipitates.

2. The article of claim 1, wherein the manganese carbide is $Mn_7C_3$.

3. The article of claim 1, wherein the article is one of a plumbing valve, a plumbing fitting and a propeller.

4. The article of claim 1, wherein the article further comprises graphite particles in contact with or surrounded by manganese carbide precipitates.

5. The article of claim 1, wherein a volume fraction of the manganese carbide precipitates is 2.2%.

6. A copper-manganese alloy having a melting temperature range of a Cu—Mn alloy system capable of avoiding or reducing dendritic growth during solidification of the copper-manganese alloy, compared to dendritic growth during solidification of a copper-manganese alloy containing less than 32 weight percent manganese, to avoid formation of microporosity attributable to dendritic growth, containing a microstructure free of dendritic growth or containing a combination of cellular growth and dendritic growth, and an amount of carbon capable of forming manganese carbide precipitates during solidification of the copper-manganese alloy, wherein the copper-manganese alloy contains at least 32 weight percent and not more than 36 weight percent manganese.

7. The copper-manganese alloy of claim 6, wherein the carbon content is derived from a melting vessel used to melt the copper-manganese alloy.

8. The copper-manganese alloy of claim 6, wherein the copper-manganese alloy contains graphite particles in contact with or surrounded by manganese carbide precipitates.

9. The copper-manganese alloy of claim 6, wherein a volume fraction of the manganese carbide precipitates is 2.2%.

10. A wrought article made of a copper-manganese alloy comprising: an amount of manganese that is at least 32 weight percent and not more than 36 weight percent of a combined total amount of copper and manganese in the copper-manganese alloy having a melting temperature range of a Cu—Mn alloy system capable of avoiding or reducing dendritic growth in a corresponding cast form, compared to dendritic growth during solidification of a copper-manganese alloy containing less than 32 weight percent manganese, containing a microstructure free of dendritic growth or containing a combination of cellular growth and dendritic growth, and comprising manganese carbide precipitates.

11. The wrought article of claim 10, wherein the manganese carbide is $Mn_7C_3$.

12. The wrought article of claim 10, wherein the wrought article is one of a plumbing valve, a plumbing fitting and a propeller.

13. The wrought article of claim 11, wherein the wrought article is one of a plumbing valve, a plumbing fitting and a propeller.

14. The wrought article of claim 10, wherein the wrought article further comprises graphite particles in contact with or surrounded by manganese carbide precipitates.

15. The wrought article of claim 10, wherein a volume fraction of the manganese carbide precipitates is 2.2%.

* * * * *